US011686519B2

(12) United States Patent
Knatt

(10) Patent No.: US 11,686,519 B2
(45) Date of Patent: Jun. 27, 2023

(54) ICE MAKER WITH PULSED FILL ROUTINE

(71) Applicant: True Manufacturing Co., Inc., O'Fallon, MO (US)

(72) Inventor: Kevin Knatt, O'Fallon, MO (US)

(73) Assignee: TRUE MANUFACTURING CO., INC., O'Fallon, MO (US)

( * ) Notice: Subject to any disclaimer, the term of this patent is extended or adjusted under 35 U.S.C. 154(b) by 1 day.

(21) Appl. No.: 17/378,997

(22) Filed: Jul. 19, 2021

(65) Prior Publication Data

US 2023/0017067 A1 Jan. 19, 2023

(51) Int. Cl.
*F25C 1/25* (2018.01)
*F25C 1/12* (2006.01)

(52) U.S. Cl.
CPC ..... *F25C 1/25* (2018.01); *F25C 1/12* (2013.01); *F25C 2400/14* (2013.01); *F25C 2600/04* (2013.01); *F25C 2700/04* (2013.01)

(58) Field of Classification Search
CPC ..... F25C 2700/04; F25C 1/25; F25C 1/12; F25C 2400/14; F25C 2600/14
See application file for complete search history.

(56) References Cited

U.S. PATENT DOCUMENTS 2,723,536 A 11/1955 Mason
3,171,266 A 3/1965 Louis
3,430,452 A 3/1969 Ricks et al.
3,731,496 A 5/1973 Frazier
3,788,095 A 1/1974 Grace et al.
3,812,686 A 5/1974 Tester
3,913,349 A 10/1975 Johnson
4,458,503 A 7/1984 Nelson
5,477,694 A 12/1995 Black et al.
5,479,707 A 1/1996 Alvarez et al.
(Continued)

FOREIGN PATENT DOCUMENTS

GB 1244831 9/1971
JP H08285419 A 11/1996
(Continued)

OTHER PUBLICATIONS

US 10,852,003 B2, 12/2020, Stroh (withdrawn)
(Continued)

*Primary Examiner* — Cassey D Bauer
(74) *Attorney, Agent, or Firm* — Stinson LLP

(57) ABSTRACT

A batch ice maker can execute a pulsed fill routine in which a control system pulses water from a water supply into the sump until the sump reaches a predefined freeze routine starting level. Pulsing may begin after continuously filling the sump to a fill-approach level. A batch ice maker can execute a differential freeze routine in which the control system circulates water from a sump to an ice formation device until water level decreases by a predefined differential amount from a high control water level based on the water level in the sump at a point in time after the sump was filled to a freeze routine starting level. The high control water level can be set based on water level in the sump when sump water temperature reaches a predefined pre-chill temperature. The predefined pre-chill temperature can be associated with a switchover from sensible cooling to latent cooling.

13 Claims, 4 Drawing Sheets

(56) References Cited

U.S. PATENT DOCUMENTS

| | | | |
|---|---|---|---|
| 5,922,030 | A | 7/1999 | Shank et al. |
| 6,058,732 | A | 5/2000 | Kato et al. |
| 6,105,385 | A | 8/2000 | Kato et al. |
| 6,109,055 | A | 8/2000 | Kato et al. |
| 6,196,007 | B1 | 3/2001 | Schlosser et al. |
| 6,209,340 | B1 | 4/2001 | Lu |
| 6,257,009 | B1 | 7/2001 | Tsuchikawa |
| 6,324,855 | B1 | 12/2001 | Mullis |
| 6,418,736 | B1 | 7/2002 | Cover |
| 6,453,696 | B1 | 9/2002 | Kawasumi et al. |
| 6,463,746 | B1 | 10/2002 | Bethuy et al. |
| 6,484,530 | B1 | 11/2002 | Hobino et al. |
| 6,607,096 | B2 | 8/2003 | Glass et al. |
| 6,612,126 | B2 | 9/2003 | Kawasumi et al. |
| 6,637,227 | B2 | 10/2003 | Stensrud et al. |
| 6,668,575 | B2 | 12/2003 | Stensrud et al. |
| 6,681,580 | B2 | 1/2004 | Shedivy et al. |
| 6,705,107 | B2 | 3/2004 | Schlosser et al. |
| 6,761,036 | B2 | 7/2004 | Teague et al. |
| 6,821,362 | B2 | 11/2004 | Satou |
| 6,854,277 | B2 | 2/2005 | Gist et al. |
| 6,880,358 | B2 | 4/2005 | Lucas et al. |
| 6,907,744 | B2 | 6/2005 | Miller et al. |
| 7,010,932 | B2 | 3/2006 | Kuroyanagi et al. |
| 7,017,355 | B2 | 3/2006 | Allison et al. |
| D526,338 | S | 8/2006 | McDougal et al. |
| 7,168,262 | B2 | 1/2007 | Hirano et al. |
| D537,457 | S | 2/2007 | McDougal et al. |
| D540,830 | S | 4/2007 | Gunshi |
| 7,197,889 | B2 | 4/2007 | Wakatsuki et al. |
| 7,204,091 | B2 | 4/2007 | Allison et al. |
| 7,273,990 | B2 | 9/2007 | Yoshida et al. |
| 7,281,386 | B2 | 10/2007 | McDougal et al. |
| 7,284,391 | B2 | 10/2007 | Miller et al. |
| 7,287,671 | B2 | 10/2007 | Morrow, Sr. et al. |
| D557,716 | S | 12/2007 | Okuda |
| 7,343,749 | B2 | 3/2008 | Tsuchikawa et al. |
| 7,444,828 | B2 | 11/2008 | Kadowaki et al. |
| 7,444,829 | B2 | 11/2008 | Mori et al. |
| D597,107 | S | 7/2009 | Ohtake |
| 7,779,641 | B2 | 8/2010 | Lee et al. |
| 7,802,444 | B2 | 9/2010 | Landers et al. |
| 7,832,219 | B2 | 11/2010 | Baranowski et al. |
| 7,975,497 | B2 | 7/2011 | Kaga et al. |
| 7,980,090 | B2 | 7/2011 | Lanzani |
| 8,042,344 | B2 | 10/2011 | Morimoto et al. |
| D649,565 | S | 11/2011 | LaFond et al. |
| 8,087,533 | B2 | 1/2012 | Sellers |
| D653,682 | S | 2/2012 | Herning et al. |
| 8,136,365 | B2 | 3/2012 | Kaga et al. |
| 8,230,696 | B2 | 7/2012 | Yamaguchi et al. |
| D668,272 | S | 10/2012 | Ebelt et al. |
| D668,275 | S | 10/2012 | LaFond et al. |
| D669,920 | S | 10/2012 | LaFond et al. |
| D673,185 | S | 12/2012 | LaFond et al. |
| 8,336,741 | B2 | 12/2012 | Graviss et al. |
| 8,341,968 | B2 | 1/2013 | Landers et al. |
| 8,375,738 | B2 | 2/2013 | Kawasumi et al. |
| 8,387,826 | B2 | 3/2013 | Tsubouchi et al. |
| 8,484,935 | B2 | 7/2013 | LeBlanc et al. |
| 8,505,595 | B2 | 8/2013 | Bragg et al. |
| 8,528,357 | B2 | 9/2013 | Kondo et al. |
| D690,743 | S | 10/2013 | Lafond et al. |
| D692,032 | S | 10/2013 | LaFond et al. |
| 8,567,013 | B2 | 10/2013 | Yamaoka et al. |
| 8,677,774 | B2 | 3/2014 | Yamaguchi et al. |
| 8,677,777 | B2 | 3/2014 | Yamaguchi et al. |
| D705,825 | S | 5/2014 | Lafond et al. |
| 8,738,302 | B2 | 5/2014 | Tirumala et al. |
| 8,763,851 | B2 | 7/2014 | Jiang et al. |
| 8,844,312 | B2 | 9/2014 | Yoshida et al. |
| 9,038,410 | B2 | 5/2015 | Erbs et al. |
| D734,783 | S | 6/2015 | Yong et al. |
| 9,052,130 | B2 | 6/2015 | Schlosser |
| 9,061,881 | B2 | 6/2015 | Brown et al. |
| D734,371 | S | 7/2015 | Lei et al. |
| 9,097,450 | B2 | 8/2015 | Kim et al. |
| 9,126,815 | B2 | 9/2015 | Cooper et al. |
| 9,146,049 | B2 | 9/2015 | Yamaguchi et al. |
| 9,151,528 | B2 | 10/2015 | Erbs et al. |
| 9,188,378 | B2 | 11/2015 | Maples |
| 9,217,597 | B2 | 12/2015 | Mueller et al. |
| 9,243,833 | B2 | 1/2016 | Yun et al. |
| 9,316,426 | B2 | 4/2016 | Almblad |
| 9,346,659 | B2 | 5/2016 | Brown |
| 9,351,571 | B2 | 5/2016 | Myers et al. |
| 9,389,009 | B2 | 7/2016 | Olson, Jr. et al. |
| 9,625,199 | B2 | 4/2017 | Antoine et al. |
| 9,643,828 | B2 | 5/2017 | Brown et al. |
| 9,803,907 | B2 | 10/2017 | Erbs et al. |
| 9,933,195 | B2 | 4/2018 | Roth et al. |
| 9,939,186 | B2 | 4/2018 | Roth et al. |
| 10,001,306 | B2 | 6/2018 | Litchy et al. |
| 10,059,580 | B2 | 8/2018 | Wyatt et al. |
| 10,107,540 | B2 | 10/2018 | Olson, Jr. et al. |
| 10,156,393 | B2 | 12/2018 | Tarr et al. |
| 10,264,943 | B2 | 4/2019 | Toga et al. |
| 10,266,383 | B2 | 4/2019 | Haskayne |
| 10,274,239 | B2 | 4/2019 | Kobayashi et al. |
| 10,300,161 | B2 | 5/2019 | Erbs |
| 10,480,843 | B2 | 11/2019 | Short et al. |
| 10,731,864 | B2 | 8/2020 | Wild |
| 10,801,770 | B2 | 10/2020 | Broadbent |
| 10,829,347 | B2 | 11/2020 | Rudy et al. |
| 10,866,020 | B2 | 12/2020 | Hoti et al. |
| 2006/0026986 | A1 | 2/2006 | Miller et al. |
| 2009/0179040 | A1 | 7/2009 | Hawkins |
| 2010/0251733 | A1 | 10/2010 | Kim et al. |
| 2014/0137593 | A1 | 5/2014 | Broadbent |
| 2014/0137594 | A1 | 5/2014 | Broadbent |
| 2014/0137984 | A1 | 5/2014 | Broadbent |
| 2014/0144175 | A1 | 5/2014 | Broadbent |
| 2014/0208781 | A1 | 7/2014 | Broadbent |
| 2014/0208792 | A1 | 7/2014 | Broadbent |
| 2014/0209125 | A1 | 7/2014 | Broadbent |
| 2014/0216071 | A1 | 8/2014 | Broadbent |
| 2015/0192338 | A1 | 7/2015 | Knatt |
| 2015/0377538 | A1 | 12/2015 | Rockwell |
| 2016/0003515 | A1 | 1/2016 | Brunner et al. |
| 2016/0007801 | A1 | 1/2016 | Bressner et al. |
| 2016/0016133 | A1 | 1/2016 | Merritt et al. |
| 2016/0045063 | A1 | 2/2016 | Mantle et al. |
| 2016/0054043 | A1 | 2/2016 | Broadbent |
| 2016/0054044 | A1 | 2/2016 | Jeong et al. |
| 2016/0095450 | A1 | 4/2016 | Trulaske, Sr. |
| 2016/0159520 | A1 | 6/2016 | Vemula et al. |
| 2016/0290697 | A1 | 10/2016 | Broadbent et al. |
| 2016/0298893 | A1 | 10/2016 | Knatt et al. |
| 2016/0327352 | A1 | 11/2016 | Broadbent et al. |
| 2016/0334157 | A1 | 11/2016 | Broadbent et al. |
| 2016/0370061 | A1 | 12/2016 | Erbs |
| 2017/0003062 | A1 | 1/2017 | Olson, Jr. et al. |
| 2017/0023284 | A1 | 1/2017 | Broadbent |
| 2017/0067678 | A1 | 3/2017 | Melton et al. |
| 2017/0176077 | A1 | 6/2017 | Knatt |
| 2017/0183210 | A1 | 6/2017 | Wyatt et al. |
| 2017/0370628 | A1 | 12/2017 | Knatt |
| 2018/0017304 | A1 | 1/2018 | Knatt |
| 2018/0023847 | A1 | 1/2018 | Kobayashi et al. |
| 2018/0023874 | A1 | 1/2018 | Kobayashi et al. |
| 2018/0031294 | A1 | 2/2018 | Olson, Jr. et al. |
| 2018/0106521 | A1 | 4/2018 | Broadbent et al. |
| 2018/0142932 | A1 | 5/2018 | Knatt et al. |
| 2018/0283760 | A1 | 10/2018 | Knatt et al. |
| 2018/0313593 | A1 | 11/2018 | Olvera et al. |
| 2019/0008004 | A1 | 1/2019 | Wild |
| 2020/0003471 | A1 | 1/2020 | Broadbent |
| 2020/0400358 | A1 | 12/2020 | Romagnoli |
| 2021/0222937 | A1 | 7/2021 | Knatt et al. |

FOREIGN PATENT DOCUMENTS

| | | | | |
|---|---|---|---|---|
| JP | 2006010181 | A | 1/2006 | |
| KR | 10-1707636 | * | 2/2017 | ..... F25C 5/08 |

(56) References Cited

FOREIGN PATENT DOCUMENTS

| | | | |
|---|---|---|---|
| WO | 20150065564 | A1 | 5/2015 |
| WO | 20150171121 | A1 | 11/2015 |
| WO | 20160007738 | A1 | 1/2016 |
| WO | 20160011103 | A1 | 1/2016 |
| WO | 20160025845 | A1 | 2/2016 |
| WO | 20160057064 | A1 | 4/2016 |
| WO | 201600654866 | A1 | 4/2016 |
| WO | 20160089410 | A1 | 6/2016 |
| WO | 201600146082 | A1 | 9/2016 |
| WO | 20160181702 | A1 | 11/2016 |
| WO | 20160205685 | A1 | 12/2016 |
| WO | 20170004212 | A1 | 1/2017 |
| WO | 20170077295 | A1 | 5/2017 |
| WO | 20170083359 | A1 | 5/2017 |
| WO | 2017095691 | A1 | 6/2017 |
| WO | 2017102494 | A1 | 6/2017 |
| WO | 2017162680 | A1 | 9/2017 |
| WO | 2017180578 | A1 | 10/2017 |
| WO | 2017182214 | A1 | 10/2017 |
| WO | 2018007318 | A1 | 1/2018 |
| WO | 20180011711 | A1 | 1/2018 |
| WO | 20180022097 | A1 | 2/2018 |
| WO | 20180147843 | A1 | 8/2018 |
| WO | 20180148096 | A1 | 8/2018 |
| WO | 2018158186 | A1 | 9/2018 |
| WO | 2019143354 | A1 | 7/2019 |
| WO | 2019164480 | A1 | 8/2019 |

OTHER PUBLICATIONS

Machine English language translation of KR 10-1707636. Translated Jan. 2023 (Year: 2017).*

Partial European Search Report from EP Application No. 22184218.0 dated Nov. 23, 2022, 14 pages.

* cited by examiner

ICE MAKER WITH PULSED FILL ROUTINE

FIELD

The present disclosure generally relates to an ice maker of the type that distributes water from a sump onto an ice formation device to form ice.

BACKGROUND

Ice makers are in wide commercial and residential use. Certain ice makers (e.g., batch-type ice makers) operate by imparting water into a sump and the circulating water from the sump onto an ice formation device until a quantity of the water forms into ice on the ice formation device. For example, flow-down batch ice makers direct water from a sump to flow down along the front side of a generally vertical freeze plate. Some of the water freezes into ice, and the water that does not freeze falls into the sump so it can be recirculated to the freeze plate. Vertical spray batch ice makers operate by spraying sump water upward into downwardly opening ice molds in a horizontal freeze plate. Some of the water freezes into ice in the molds, and the unfrozen water is directed back to the sump where it can be recirculated.

SUMMARY

In one aspect, an ice maker comprises an ice formation device in which to form ice. A water system comprises a sump for holding water. A water pump is configured to circulate water from the sump to the ice formation device. A water inlet valve is configured to connect to a water supply. The water inlet valve is configured to selectively open and close to selectively impart water from the water supply into the sump. A refrigeration system is configured to cool the ice formation device for forming at least some of the water circulated by the water system into ice. A control system is configured to control the refrigeration system and the water system to conduct ice batch production cycles in which batches of ice are formed in the ice formation device. The control system includes a controller and a water level sensor configured to output a signal representative of water level in the sump to the controller. The controller is configured to execute a fill routine during each ice batch production cycle, during each fill routine. The controller is configured to fill the sump to a fill-approach level by opening the water inlet valve until the water level sensor outputs a signal indicating the water level in the sump has reached the fill-approach level. After receiving the signal indicating the water level in the sump as reached the fill-approach level, the water inlet valve is closed. After closing the water inlet valve, the sump is filled further to a freeze routine starting level by pulsing water through the water inlet valve until the water level sensor outputs a signal indicating the water level in the sump has reached the freeze routine starting level.

In another aspect, an ice maker comprises an ice formation device in which to form ice. A water system comprises a sump for holding water and a pump configured to circulate water from the sump to the ice formation device. A refrigeration system is configured to cool the ice formation device for forming at least some of the water circulated by the water system into ice. A control system is configured to control the refrigeration system and the water system to conduct ice batch production cycles in which batches of ice are formed in the ice formation device. During each ice batch production cycle, the control system is configured to execute a differential freeze routine in which the control system circulates water from the sump to the ice formation device until water level decreases by a predefined differential amount from a high control water level based on the water level in the sump at a point in time after the sump was filled to a freeze routine starting level.

In another aspect, an ice maker comprises an ice formation device in which to form ice. A water system comprises a sump for holding water and a pump configured to circulate water from the sump to the ice formation device. A refrigeration system is configured to cool the ice formation device for forming at least some of the water circulated by the water system into ice. A control system is configured to control the refrigeration system and the water system to conduct ice batch production cycles in which batches of ice are formed in the ice formation device. The control system includes a controller, a water level sensor configured to output a signal to the controller representative of water level in the sump, and a temperature sensor configured to output a signal to the controller representative of temperature of the water in the sump. The controller is configured to execute a differential freeze routine during each ice batch production cycle. During each differential freeze routine, the controller is configured to run the water pump to circulate water from the sump to the ice formation device. While running the water pump, the controller determines based on the signal output by the temperature sensor when the temperature of the water in the sump decreases to a pre-chill threshold, set a high control water level to a water level based on the signal output from the water level sensor when the water level in the sump decreases to the pre-chill temperature threshold, and determines based on the signal output from the water level sensor when the water level in the sump decreases from the high control water level by a predefined differential amount. The controller turns off the water pump in response to determining the water level in the sump has decreased from the high control water level by the predefined differential amount.

In another aspect, an ice maker comprises an ice formation device in which to form ice. A water system comprises a sump for holding water and a pump configured to circulate water from the sump to the ice formation device. A refrigeration system is configured to cool the ice formation device for forming at least some of the water circulated by the water system into ice. A control system is configured to control the refrigeration system and the water system to conduct ice batch production cycles in which batches of ice are formed in the ice formation device. The control system is configured to execute a pulsed fill routine during each ice batch production cycle in which the control system pulses water from a water supply into the sump until the sump reaches a predefined freeze routine starting level.

Other aspects will be in part apparent and in part pointed out hereinafter.

BRIEF DESCRIPTION OF THE DRAWINGS

Corresponding parts are given corresponding reference numbers throughout the drawings.

DETAILED DESCRIPTION

Figure 1:
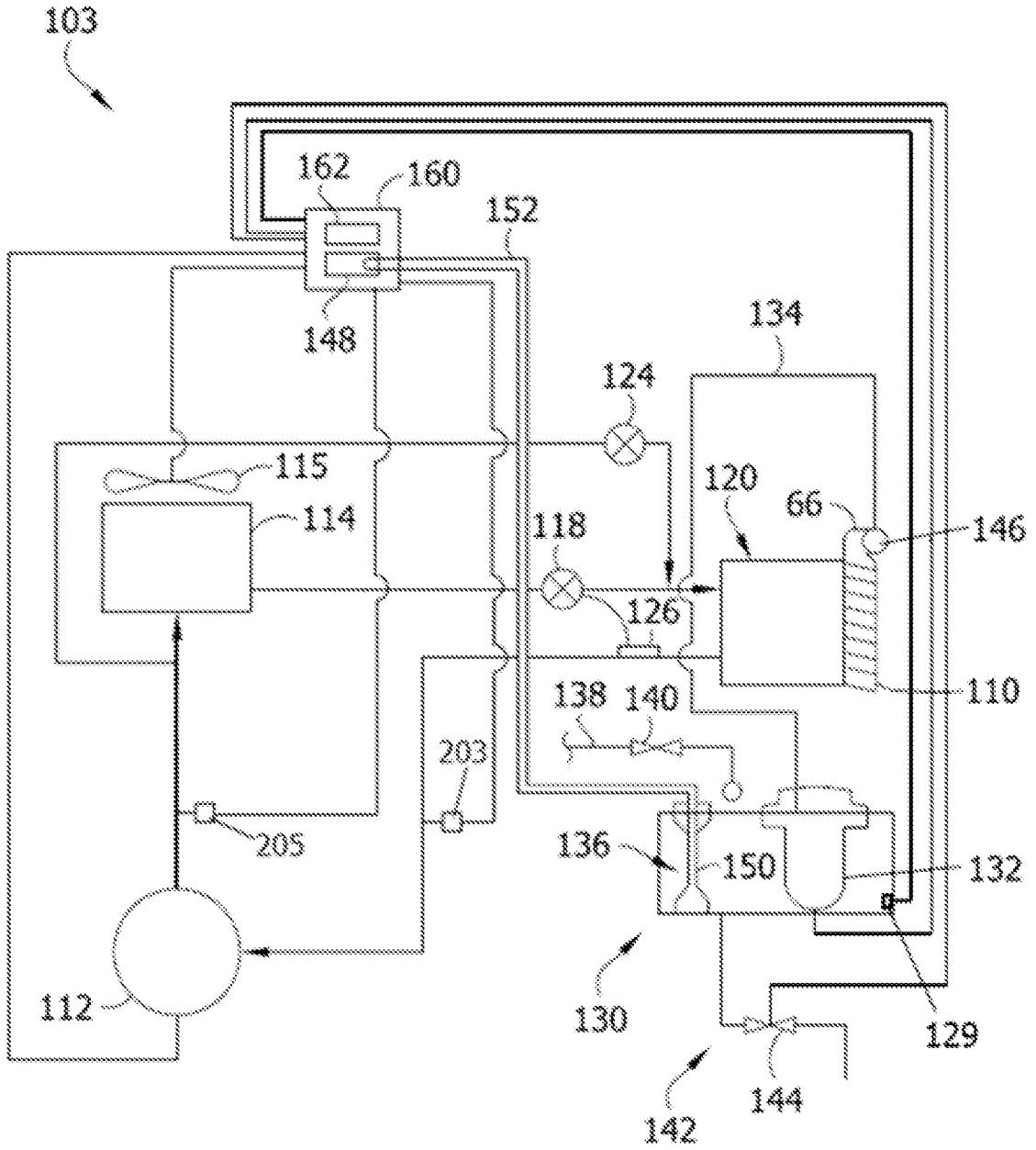
FIG. 1 is a schematic illustration of an ice maker.

Referring to FIG. 1, an exemplary embodiment of an ice maker is generally indicated at reference number 103. Ice makers in the scope of this disclosure may broadly comprise an ice formation device on which water can form into pieces of ice, a water system for circulating water to the ice formation device, and a refrigeration system configured to directly cool the ice formation device to a temperature at which at least some of the liquid water present on the ice formation device will freeze into ice. In the illustrated embodiment, the ice maker is a batch ice maker of the type which has a generally vertical freeze plate 110 that constitutes the ice formation device. Other types of batch ice makers such as vertical spray ice makers are also contemplated to be in the scope of this disclosure. In a vertical spray ice maker, the ice formation device is typically a horizontal freeze plate including ice piece molds that open downward for receiving vertically sprayed water that forms into ice in the molds.

The refrigeration system of the ice maker 103 includes a compressor 112, a heat rejecting heat exchanger 114, a refrigerant expansion device 118 for lowering the temperature and pressure of the refrigerant, an evaporator 120 along the back side of the freeze plate 110, and a hot gas valve 124. The compressor 112 can be a fixed speed compressor or a variable speed compressor to provide a broader range of operational control possibilities. As shown, the heat rejecting heat exchanger 114 may comprise a condenser for condensing compressed refrigerant vapor discharged from the compressor 112. In other embodiments, e.g., in refrigeration systems that utilize carbon dioxide refrigerants where the heat of rejection is trans-critical, the heat rejecting heat exchanger is able to reject heat from the refrigerant without condensing the refrigerant. Hot gas valve 124 is selectively opened to direct warm refrigerant from the compressor 114 directly to the evaporator 120 to remove or harvest ice cubes from the freeze plate 110 when the ice has reached the desired thickness.

The refrigerant expansion device 118 can be of any suitable type, including a capillary tube, a thermostatic expansion valve, or an electronic expansion valve. In certain embodiments, where the refrigerant expansion device 118 is a thermostatic expansion valve or an electronic expansion valve, the ice maker 110 may also include a temperature sensor 126 placed at the outlet of the evaporator 120 to control the refrigerant expansion device 118. In other embodiments, where the refrigerant expansion device 118 is an electronic expansion valve, the ice maker 110 may also include a pressure transducer (not shown) placed at the outlet of the evaporator 120 to control the refrigerant expansion device 118 as is known in the art. In the illustrated embodiment, a condenser fan 115 is positioned to blow the gaseous cooling medium across the condenser 114. In an exemplary embodiment, the condenser fan 115 is a variable speed fan having a plurality of speed settings, including at least a normal speed and a high speed. The compressor 112 cycles a form of refrigerant through the condenser 114, expansion device 118, evaporator 120, and the hot gas valve 124, via refrigerant lines.

Referring still to FIG. 1, a water system of the illustrated ice maker 10 includes a sump 130, a water pump 132, a water line 134 (broadly, passaging), and a water level sensor 136. The water pump 132 could be a fixed speed pump or a variable speed pump to provide a broader range of control possibilities. The water system of the ice maker 103 further includes a water supply line 138 and a water inlet valve 140 for filling the sump 130 with water from a water source (e.g., a municipal water utility). The illustrated water system further includes a drain line 142 (also called, drain passaging or a discharge line) and a drain valve 144 (e.g., purge valve, drain valve; broadly, a purge device) disposed thereon for draining water from the sump 130. The sump 130 is positioned below the freeze plate 110 to catch water coming off of the freeze plate such that the relatively cool water falling from the freeze plate may be recirculated by the water pump 132. The water line 134 fluidly connects the water pump 132 to a water distributor 146 above the freeze plate. During an ice batch production cycle, the pump 132 is configured to pump water through the water line 134 and through the distributor 146. The distributor is configured to distribute the water imparted through the distributor 146 evenly across the front of the freeze plate 110 so that the water flows downward along the freeze plate and any unfrozen water falls off of the bottom of the freeze plate into the sump 130.

In an exemplary embodiment, the water level sensor 136 comprises a remote air pressure transducer 148. Various types of water level sensors may be used without departing from the scope of the disclosure, but in exemplary embodiments, the water level sensor comprises a transducer that outputs a signal that continuously varies with water level as opposed to a conventional float switch that only changes its output at one or a small number of pre-selected water levels. Thus, in one or more embodiments, the illustrated water level sensor could be replaced with an acoustic sensor, an electrical continuity sensor, a float sensor with a mechanical transducer providing a continuously variable output, etc. It is also contemplated that one or more float switches could be employed to implement certain aspects of level-based control described herein (e.g., the below-discussed pulsed fill routine could be executed using a float switch configuration instead of a level transducer).

The illustrated water level sensor 136 includes a fitting 150 that is configured to couple the sensor to the sump 130. The fitting 150 is fluidly connected to a pneumatic tube 152. The pneumatic tube 152 provides fluid communication between the fitting 150 and the air pressure transducer 148. Water in the sump 130 traps air in the fitting 150 and compresses the air by an amount that varies with the level of the water in the sump. Thus, the water level in the sump 130 can be determined using the pressure detected by the air pressure transducer 148. Additional details of exemplary embodiments of a water level sensor comprising a remote air pressure transducer are described in U.S. Patent Application Publication No. 2016/0054043, which is hereby incorporated by reference in its entirety.

Figure 2:
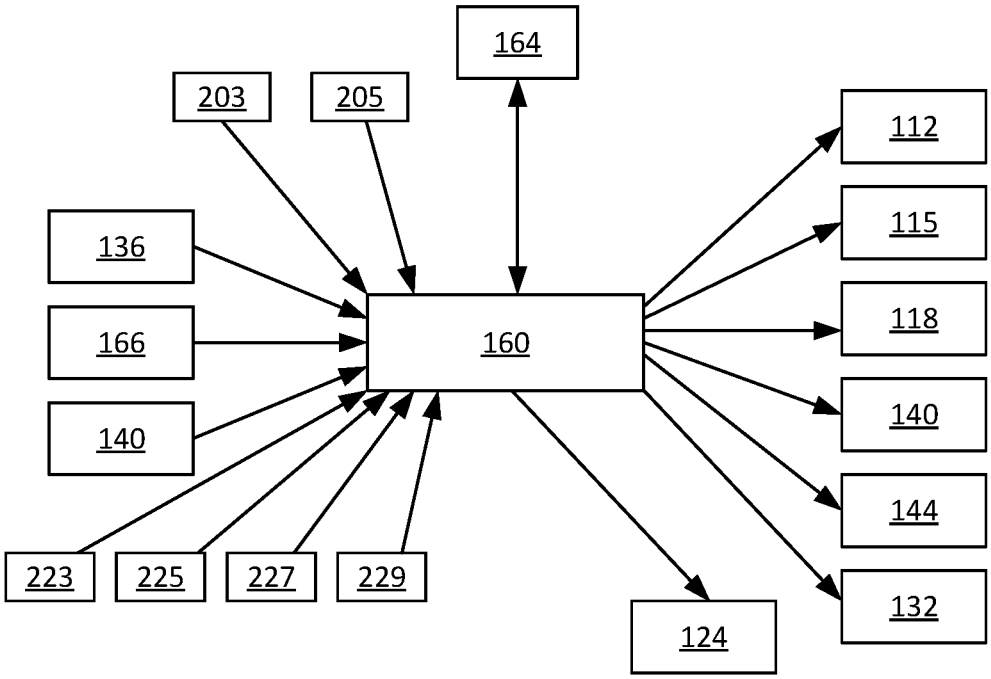
FIG. 2 is schematic block diagram of a control system of the ice maker.

Referring to FIGS. 1 and 2, the ice maker 103 includes a controller 160 (e.g., a "local controller" or an "appliance controller"). The controller 160 includes at least one processor 162 for controlling the operation of the ice maker 103, e.g., for controlling at least one of the refrigeration system and the water system. The processor 162 of the controller 160 may include a non-transitory processor-readable medium storing code representing instructions to cause the processor to perform a process. The processor 162 may be, for example, a commercially available microprocessor, an application-specific integrated circuit (ASIC) or a combination of ASICs, which are designed to achieve one or more specific functions, or enable one or more specific devices or applications. In certain embodiments, the controller 160 may be an analog or digital circuit, or a combination of multiple circuits. The controller 160 may also include one or more memory components 164 (FIG. 2) for storing data in a form retrievable by the controller. The controller 160 can store data in or retrieve data from the one or more memory components.

Figure 3:
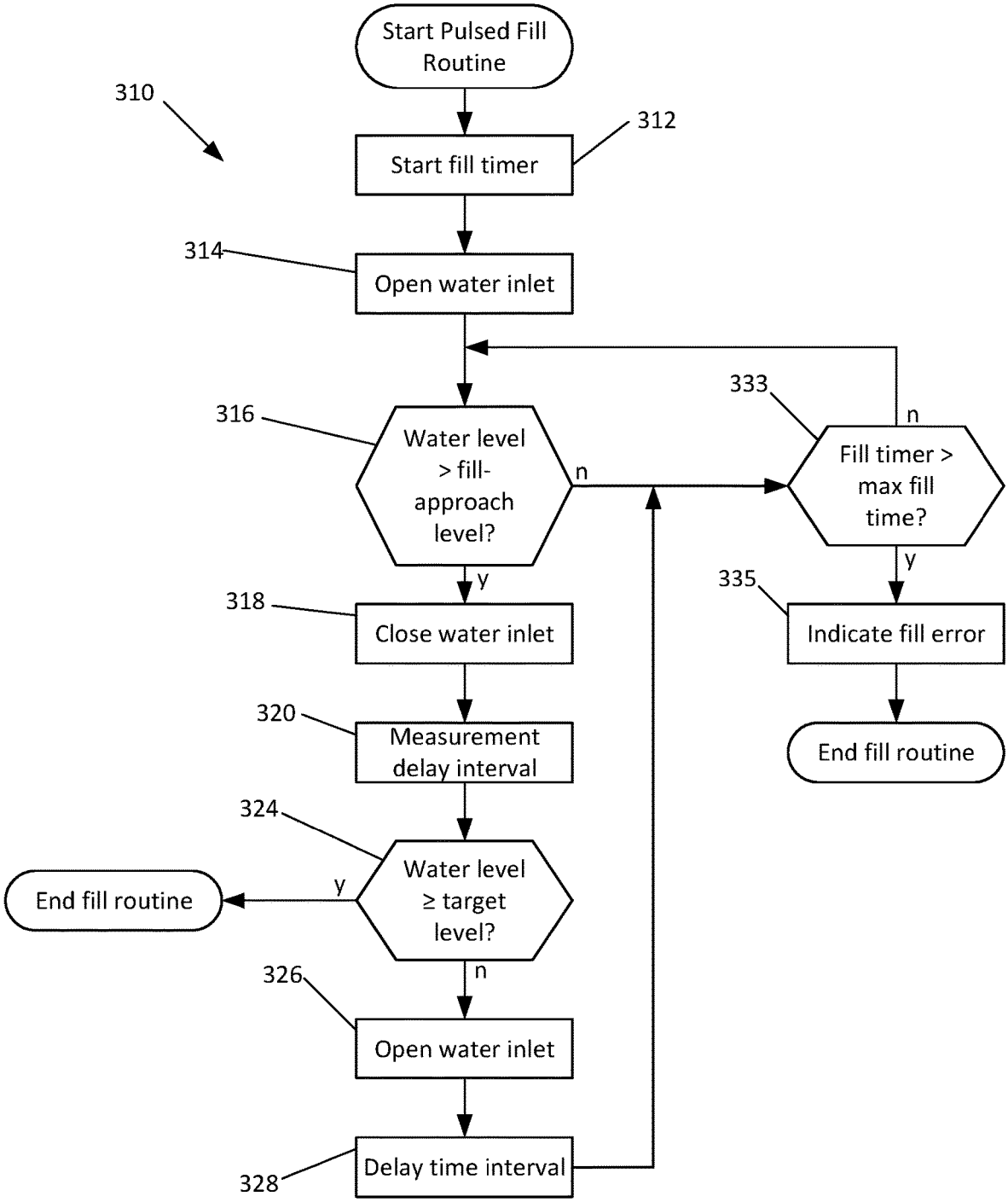
FIG. 3 is a flow chart illustrating the steps and decision points of a pulsed fill routine executed by the control system.

Referring to FIG. 3, in various embodiments, the controller 160 may also comprise input/output (I/O) components to communicate with and/or control the various components of ice maker 103. In certain embodiments, the controller 160 may receive inputs such as, for example, one or more indications, signals, messages, commands, data, and/or any other information, from the water level sensor 136, a harvest sensor 166 for determining when ice has been harvested, an electrical power source (not shown), an ice level sensor 140 for detecting the level of ice in a bin (not shown) below the ice maker 103, and/or a variety of sensors and/or switches including, but not limited to, pressure transducers, temperature sensors, acoustic sensors, etc. The illustrated control system includes an integrated low side pressure transducer 203 and high side pressure transducer 205 that are configured to output (analog) signals to the controller 160 representative of refrigerant pressures upstream and downstream of the compressor 112 (e.g., the line pressure of the suction line and discharge line, respectively). Further, the illustrated control system comprises an evaporator temperature sensor 223 configured to output a signal representative of the temperature of the evaporator 120, an air temperature sensor 225 configured to output a signal representative of the temperature of air inside the ice maker 103, a water inlet temperature sensor 227 configured to output a signal representative of the temperature of water imparted into the ice maker, and a sump temperature sensor 229 configured to output a signal representative of a temperature of water in the sump 130.

In various embodiments, based on the above-described inputs and predefined control instructions stored in the memory components 164, the controller 160 controls the ice maker 103 by outputting control signals to controllable output components such as the compressor 112, the condenser fan 115, the refrigerant expansion device 118, the hot gas valve 124, the water inlet valve 140, the drain valve 144, and/or the water pump 132. Such control signals may include one or more indications, signals, messages, commands, data, and/or any other information to such components.

In one or more embodiments, the hermetically sealed refrigeration system is charged with natural gas refrigerant. In an exemplary embodiment the refrigerant is r290. In certain embodiments, the natural gas refrigerant has a total charge of less than 150 g. Other types of refrigerants and levels of refrigerant charge could also be used without departing from the scope of the disclosure.

Exemplary methods of using the ice maker 103 will now be briefly described. First, this disclosure provides a general overview of how the ice maker 103 conducts an ice batch production process. Subsequently, this disclosure describes exemplary routines that can be executed by the control system to improve consistency in ice batch volume and thereby improve the performance and reliability of the ice maker 103.

In general, the illustrated ice maker 103 is configured to conduct consecutive ice batch production cycles. Each ice batch production cycle comprises discrete routines for freezing the ice (a freeze routine), harvesting the ice (an ice harvesting routine), and filling the sump 130 (a fill routine). At least some of the ice batch production cycles can further comprise routines for purging hard water from the sump 130 after a batch of ice is formed and before the sump is refilled (a purge routine).

In general, during a freeze routine, the refrigeration system is operated to cool the freeze plate 110. At the same time, the pump 132 circulates water from the sump 130 through the water line 134 and further through the distributor 146. The distributor 146 distributes water along the top portion of the freeze plate 110. As the water flows down the front of the freeze plate 110, some of the water freezes into ice, forming ice pieces on the freeze plate of gradually increasing thickness. The unfrozen water falls off of the freeze plate 110 back into the sump 130.

When the ice reaches a thickness that is suitable for harvesting, the controller 160 switches from the freeze routine to the ice harvesting routine. Various methods are used in conventional ice makers to determine when ice achieves the desired volume (e.g., when ice on the freeze plate accumulates to the desired thickness). In one method, the freeze routine is terminated and harvest is initiated in response to a signal from the water level sensor indicating the gross water level in the sump has decreased to a predefined level believed to be correlated to the desired volume of ice. As will be explained in further detail below, the present disclosure contemplates a new approach to determining when the desired amount of ice has been formed by the freeze routine. Instead of relying on a predefined gross water level, the new freezer routine (called a differential freeze routine herein) measures a high control water level at a point in time that provides substantially consistent conditions from batch to batch. Subsequently, the control system transitions from the freeze routine to the harvest routine when the water level decreases by a predefined differential amount associated with the preferred (target) ice volume.

Upon switchover from freeze routine to harvest routine, the controller turns off the pump 132 and opens the hot gas valve 124 to redirect hot refrigerant gas to the evaporator 120. The hot gas warms the freeze plate 110, causing the ice to melt. The melting ice falls from the freeze plate into an ice bin (not shown) below. The controller 160 closes the hot gas valve 124 after the ice has fallen from the freeze plate, as indicated by the harvest sensor 166.

Before beginning another ice batch production cycle, the sump 130 must be refilled to make up for the water consumed in the previous batch of ice. Thus, before beginning a subsequent freeze step, the controller 160 conducts a fill routine in which the controller opens the water inlet valve 140 to let new supply water into the sump 130. In conventional ice makers, the water inlet valve 140 remains open until the control system registers an indication that the water level in the sump 130 reaches a desired ice making water level, at which point the water inlet valve is closed. As will be explained in further detail below, the present disclosure contemplates a more advanced freeze routine that mitigates against overshoot and undershoot that occurs using the conventional process.

As can be seen from above, after each freeze step is complete, cold water in the sump has drawn down from the ice making water level to the end-of-circulation water level, which typically leaves some water remaining in the sump. For energy efficiency purposes, it is desirable to maintain a relatively large volume of cold water in the sump 130 at the end-of-circulation level. The sump water functions as a cold reservoir and chills the new supply water that fills the sump from the end-of-circulation water level to the ice making water level. At least periodically, it is beneficial to purge a portion of the water from the sump 130. This is advantageous because, during the freeze step, as the water flows down the front of the freeze plate 110, impurities in the water such as calcium and other minerals in solution will remain in solution with the liquid water as purer water freezes. Thus, during each freeze step, the concentration of impurities in the water will increase. To counteract this phenomenon, the controller 160 will periodically conduct a purge step by opening the drain valve 144 to purge a portion of the residual water from the sump 130. The controller 160 directs the drain valve 144 to close when the water level sensor 136 provides an indication to the controller that the water level in the sump 130 reaches the desired purge level. The drain valve 144 is one suitable type of purge mechanism but other types of purge mechanisms (e.g., active drain pumps) can also be used to execute the above-described purge step without departing from the scope of the disclosure.

The inventor has recognized that the ice batch production cycle described above can be improved by ensuring that the same amount of water forms into ice during each cycle. Even small differences in the amount of water frozen in different ice batch production cycles can lead to consequential errors such as failure of ice to fully harvest during the harvest routine. A conventional approach to ensuring the same amount of water forms into ice during each cycle is to rely on predefined gross water levels in the sump. For example, during the fill routine, a conventional control system will use a water level sensor or float switch to fill the sump to a predefined fill level. That is, the conventional control system will close a water inlet valve after the water level sensor or float switch produces a signal indicating the predefined freeze routine starting level has been reached. But the inventors have recognized that this approach introduces the possibility for material differences in the ultimate water level when the freeze routine begins. Variance in water supply pressure is unavoidable. When the water level sensor or float switch outputs the signal indicating the freeze routine starting level has been reached, supply water will continue to flow for a time as and after the valve is closed. In a scenario in which the supply water pressure is very high, the amount of extra water that flows into the sump during this time interval is relatively high, whereas in the scenario in which the supply water pressure is very low, the amount of extra water that flows into the sump during this time interval is much lower. Thus, more water must form into ice before the level in the sump reaches the predefined gross water level that triggers a harvest routine when the water supply pressure is high than when the water supply pressure is low.

The inventor has also recognized that another problem that leads to inconsistent ice batch volume is splashing. In a conventional ice maker, when the water pump turns on after a fill routine is complete, some water can initially splash out of the sump as water begins to fall into the sump off of the freeze plate. But the amount of water that splashes varies from batch to batch. In a conventional ice maker, the amount of water that splashes from the sump affects the final ice batch volume. If a large amount of volume splashes out of the sump, the ice batch will have less volume because less water must freeze on the freeze plate to reach a low water level that ends the freeze routine and initiates harvest. By contrast, if no water splashes out of the sump, more water must freeze before the low water level in the sump is reached.

Figure 4:
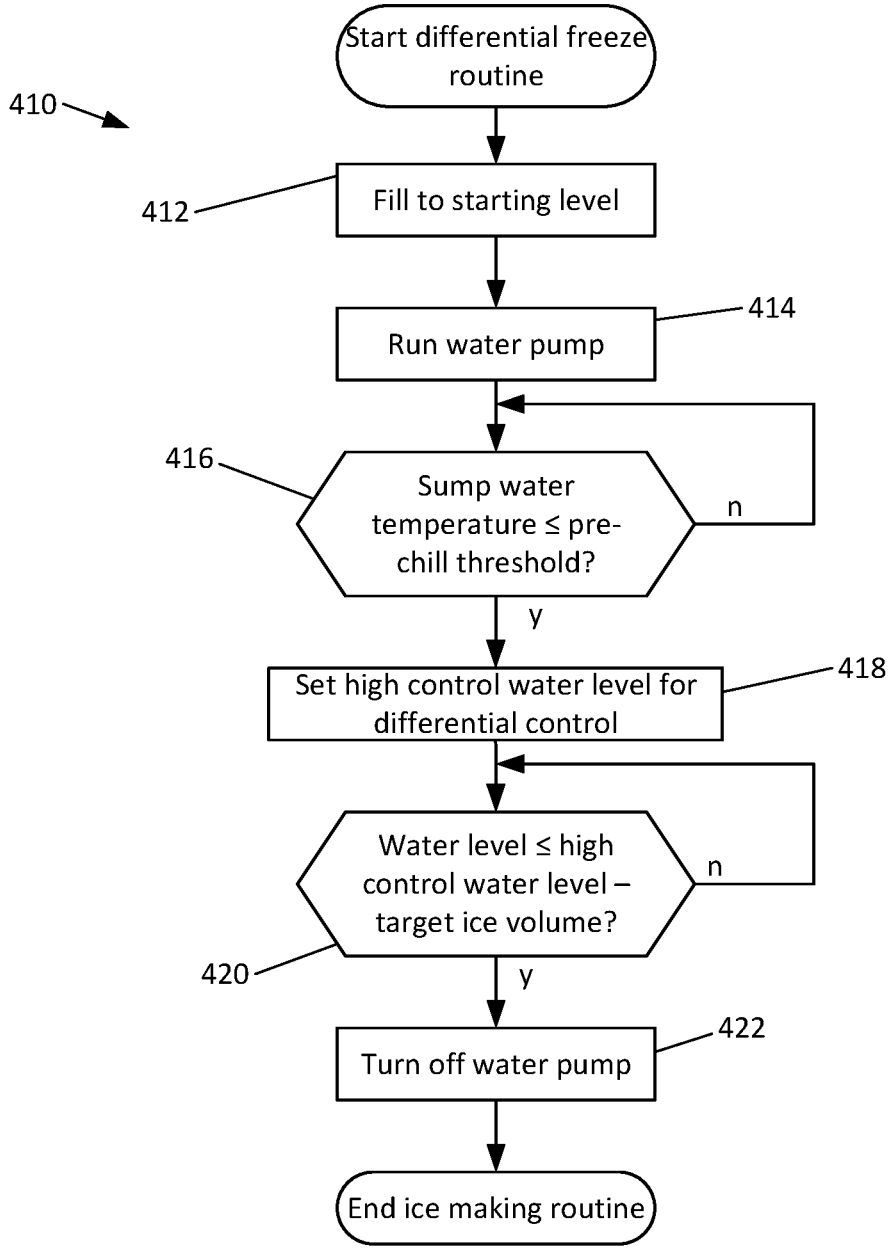
FIG. 4 is a flow chart illustrating the steps and decision points of a differential freeze routine executed by the control system.

Referring to FIGS. 3 and 4, the inventor has conceived of two methods of controlling the ice maker 103 that improve the consistency in the amount of water used in each ice batch production cycle.

In broad terms, the illustrated fill routine 310 may be referred to as a "pulsed fill routine" during which the controller 160 controls the water inlet valve 140 to pulse water from a water supply into the sump 130 until the sump reaches a predefined freeze routine starting water level. Referring to FIG. 3, at the onset of the fill routine (e.g., upon completion of a harvest routine or a purge routine of an ice batch production cycle), the controller 160 initially starts a fill timer (step 312) and opens the water inlet valve 140 (step 314). The fill timer in step 312 is used to ensure that the fill routine 310 does not take an excessive amount of time, which would indicate a malfunction such as blockage of the water supply or a leaking sump. Thus, the illustrated fill routine 310 includes a decision point 333 at which the controller determines whether the fill timer has exceeded a predefined maximum fill time and a step 335 at which the controller outputs an alarm indication indicating that a fill error has occurred when the fill timer has exceeded the predefined maximum fill time. It can be seen that the controller 160 continuously monitors the fill timer for exceeding the predefined maximum fill time until the fill routine 310 ends.

In the illustrated embodiment, the initial valve opening performed in step 314 is not a pulsing of the water inlet valve 140. Rather, in step 314 the controller 160 opens the water inlet valve 140 and keeps the water inlet valve open until, based on decision point 316, the water level sensor 136 outputs a signal indicating the water level in the sump 130 has reached a predefined fill-approach level that is less than a freeze routine starting level at which the ice maker 103 ends the fill routine 310 and begins an freeze routine 410 (FIG. 4). In one or more embodiments, the fill-approach level is in a range of from about 85% to about 95% of the freeze routine starting level. After receiving the signal indicating the water level in the sump as reached the fill-approach level, the controller 160 is configured to pulse the water from the water supply into the sump 130 until the water level sensor 136 outputs a signal indicating the water level in the sump 130 has reached the freeze routine starting level.

When, at decision point 316, the controller 160 determines that the water level in the sump 130 reaches the fill-approach water level, the controller initially closes the valve 140 (step 318) and keeps the valve closed for a measurement delay interval (step 320). The measurement delay interval may be in an inclusive range of from 1 seconds to 10 seconds. After the measurement delay interval of step 320 is complete, at decision point 322, the controller 160 determines based on the signal output by the water level sensor 136 whether the water level in the sump 130 has reached the final ice making water level. If not, at step 324, the controller 160 opens the water inlet valve for a pulse interval to impart pulse water into the sump 130. In one or more embodiments, the pulse interval is in an inclusive range of from 1 seconds to 10 seconds. The controller 160 will close the water inlet valve 140 (step 318) when the pulse interval elapses and maintain the water inlet valve closed for another measurement delay interval (step 320). Provided that the fill timer has not exceed the maximum fill time (decision point 333), the controller 160 repeats the process of opening the water inlet valve 140 for a pulse interval (328) and then closing the water inlet valve for a delay interval until, at decision point 324, the controller determines based on the signal output by the water level sensor 136 that the water level in the sump reaches the freeze routine starting level. When at decision point 324, the controller determines that the water level in the sump 130 reaches the freeze routine starting level, the controller ends the fill routine 310 and begins a freeze routine.

The inventor believes that the pulsed fill routine 310 can be used to improve the consistency in the amount of ice produced in every ice batch production cycle. Pulsing the water from the fill-approach water level to the freeze routine starting level essentially eliminates the possibility of material overshoot or undershoot and thus provides a very consistent freeze routine starting level from which to execute an freeze routine. Thus, in one or more embodiments, the pulsed fill routine 310 is used to fill the sump before conducting a gross level-based freeze routine in which the controller circulates water from the sump onto the freeze plate until the controller determines based on a water level sensor that the gross water level in the sump has reached a predefined ice making completion level. In comparison with conventional ice makers that use conventional routines for transitioning from fill routine to freeze routine, the pulsed freeze routine 300 is believed to allow for greater consistency in ice volume when controlling the freeze routine based on gross levels in the sump.

Alternatively, referring to FIG. 4, the pulsed fill routine 310 also may be used before a differential freeze routine in the scope of a further aspect of the present disclosure, which is generally indicated at reference number 410 in FIG. 4. As will be explained in further detail below, the differential freeze routine during 410 circulates water from the sump 130 to the freeze plate 110 (broadly, ice formation device) until water level in the sump decreases by a predefined differential amount from a high control water level achieved at a point in time after the sump as filled to the freeze routine starting level. The differential freeze routine 410 may also be used with ice makers that control the fill routine in other ways.

Regardless, at step 412, the controller 160 initially conducts the pulsed fill routine 310 or another fill routine to fill the sump 130 to a freeze routine starting level. Then, at step 414, the controller 160 is configured to run the water pump 132 to circulate water from the sump 130 to the freeze plate 110 while operating the refrigeration system to chill the water being circulated. The circulating water thus begins to chill.

While running the water pump, the controller 160 monitors the output of the temperature sensor 129 to determine at decision point 416 when the temperature of the water in the sump 130 decreases to a pre-chill threshold. In exemplary embodiment, the pre-chill threshold indicates the water in the sump 130 is transitioning from sensible cooling to latent cooling—that is, transitioning from a condition in which the cooling provided by the refrigeration system lowers the temperature of the water to a condition in which the cooling provided by the refrigeration system causes a phase change from liquid to solid without substantial temperature change. In one or more embodiments the predefined pre-chill threshold is in an inclusive range of from about 33° F. to about 38° F.

When the signal output from the temperature sensor 129 indicates that the sump water temperature has decreased to the pre-chill threshold, the controller 160 determines the water level in the sump 130 based on the signal output by the water level sensor 136 and, at step 418, sets that water level as a high control water level for purposes of differential control of the freeze routine 410. While continuing to run the water pump 132 to circulate water from the sump to the freeze plate 110, the controller 160 monitors the signal output from the water level sensor 136 to determine (based on the signal) when the water level in the sump 130 decreases from the high control water level (set in step 418) by a predefined differential amount corresponding to the desired amount of water to be formed into ice in each ice batch production cycle (see decision point 420). In response to the controller 160 determining that the water level in the sump 130 has decreased from the high control water level by the predefined differential amount in decision point 420, at step 422, the controller 160 turns off the water pump 132, ends the freeze routine 410, and begins an ice harvest routine (not shown).

By using differential control instead of absolute level control, the control system accounts for all variance that may occur due to overshooting or undershooting in a fill routine. Moreover, the inventor believes that the above-described differential control routine substantially mitigates against the adverse effects of splashing on the consistency of ice batch volume. By setting the high control water level at a time when the sump water is transitioning from sensible cooling to latent cooling, the control system ensures the subsequent differential measurement used to determine when the desired amount of ice has been formed is substantially unaffected by unpredictable events such as splash-out. Accordingly, the differential freeze routine 410 can provide improved consistency in ice batch volume.

As will be appreciated by one skilled in the art, aspects of the embodiments disclosed herein may be embodied as a system, method, computer program product or any combination thereof. Accordingly, embodiments of the disclosure may take the form of an entire hardware embodiment, an entire software embodiment (including firmware, resident software, micro-code, etc.) or an embodiment combining software and hardware aspects that may all generally be referred to herein as a "circuit," "module" or "system." Furthermore, aspects of the disclosure may take the form of a computer program product embodied in any tangible medium having computer usable program code embodied in the medium.

Aspects of the disclosure may be described in the general context of computer-executable or processor-executable instructions, such as program modules, being executed by a computer or processor. Generally, program modules include routines, programs, objects, components, data structures, etc. that perform particular tasks or implement particular abstract data types. Aspects of the disclosure may also be practiced in distributed computing environments where tasks are performed by remote processing devices that are linked through a communications network. In a distributed computing environment, program modules may be located in both local and remote computer storage media including memory storage devices.

Any combination of one or more computer usable or computer readable medium(s) may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or flash memory), an optical fiber, a portable compact disc read-only memory (CDROM), an optical storage device, a transmission media such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain or store the program for use by or in connection with the instruction execution system, apparatus, or device.

Computer program code for carrying out operations of the present disclosure may be written in any combination of one or more programming languages, including, but not limited to, an object oriented programming language such as Java, Smalltalk, C++, C# or the like and conventional procedural programming languages, such as the "C" programming language or similar programming languages. The program code may execute entirely on the portable electronic device, partly on the portable electronic device or refrigeration appliance, as a stand-alone software package, partly on the portable electronic device and partly on a remote computer, or entirely on a remote computer or server. In the latter scenario, the remote computer may be connected to the portable electronic device through any type of network, including a local area network (LAN) or a wide area network (WAN), or the connection may be made to an external computer (for example, through the Internet using an Internet Service Provider).

When introducing elements of the present disclosure or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the disclosure are achieved and other advantageous results attained.

As various changes could be made in the above products and methods without departing from the scope of the disclosure, it is intended that all matter contained in the above description shall be interpreted as illustrative and not in a limiting sense.

What is claimed is:

1. An ice maker comprising:

an ice formation device in which to form ice;

a water system comprising a sump for holding water, a water pump configured to circulate water from the sump to the ice formation device, and a water inlet valve configured to connect to a water supply, the water inlet valve being configured to selectively open and close to selectively impart water from the water supply into the sump;

a refrigeration system configured to cool the ice formation device for forming at least some of the water circulated by the water system into ice; and a control system configured to control the refrigeration system and the water system to conduct ice batch production cycles in which batches of ice are formed in the ice formation device, the control system including a controller and a water level sensor configured to output a signal representative of water level in the sump to the controller, the controller being configured to execute a fill routine during each ice batch production cycle, during each fill routine, the controller being configured to:

fill the sump to a fill-approach level by opening the water inlet valve until the water level sensor outputs a signal indicating the water level in the sump has reached the fill-approach level;

after receiving the signal indicating the water level in the sump as reached the fill-approach level, close the water inlet valve; and after closing the water inlet valve, filling the sump further to a freeze routine starting level by pulsing water through the water inlet valve until the water level sensor outputs a signal indicating the water level in the sump has reached the freeze routine starting level.

2. The ice maker of claim 1, wherein the controller is configured to pulse water through the inlet valve by repeatedly opening the valve for a predefined pulse interval and then closing the valve.

3. The ice maker of claim 2, wherein the predefined pulse interval is in an inclusive range of from 1 seconds to 10 seconds.

4. The ice maker of claim 1, wherein the controller is configured to pulse water through the inlet valve by repeatedly opening the valve for a predefined pulse interval and then closing the valve for a predefined measurement delay interval.

5. The ice maker of claim 4, wherein the measurement delay interval is in an inclusive range of rom 1 seconds to 10 seconds.

6. The ice maker of claim 1, wherein during each fill routine, the controller is configured to determine if an elapsed fill time exceeds a predefined maximum fill time and output an error indication when the elapsed fill time exceeds the predefined maximum fill time.

7. The ice maker of claim 1, wherein the controller is configured to execute a differential freeze routine during each ice batch production cycle.

8. The ice maker of claim 7, wherein the control system further comprises a temperature sensor configured to output a signal representative of temperature of the water in the sump.

9. The ice maker of claim 8, wherein during each differential freeze routine the control system is configured to run the water pump until the water level in the sump decreases by a predefined differential amount.

10. The ice maker of claim 8, wherein during each differential freeze routine, the controller is configured to;

run the water pump to circulate water from the sump to the ice formation device;

while running the water pump:

determine based on the signal output by the temperature sensor when the temperature of the water in the sump decreases to a pre-chill threshold;

set a high control water level to a water level based on the signal output from the water level sensor when the water level in the sump decreases to the pre-chill temperature threshold; and determine based on the signal output from the water level sensor when the water level in the sump decreases from the high control water level by a predefined differential amount; and turn off the water pump in response to determining the water level in the sump has decreased from the high control water level by the predefined differential amount.

11. The ice maker of claim 8, wherein after each differential freeze routine, the controller is configured to execute a harvest routine.

12. The ice maker of claim 11, wherein after each harvest routine, the controller is configured to execute the fill routine.

13. An ice maker comprising:

an ice formation device in which to form ice;

a water system comprising a sump for holding water and a pump configured to circulate water from the sump to the ice formation device;

a refrigeration system configured to cool the ice formation device for forming at least some of the water circulated by the water system into ice; and a control system configured to control the refrigeration system and the water system to conduct ice batch production cycles in which batches of ice are formed in the ice formation device, the control system being configured to execute a pulsed fill routine during each ice batch production cycle in which the control system pulses water from a water supply into the sump until the sump reaches a predefined freeze routine starting level.

* * * * *